US009609899B1

(12) United States Patent
Gadler

(10) Patent No.: US 9,609,899 B1
(45) Date of Patent: Apr. 4, 2017

(54) BODY SURFING GARMENT

(71) Applicant: WaveWrecker, LLC, El Cajon, CA (US)

(72) Inventor: Nicholas Noel Gadler, El Cajon, CA (US)

(73) Assignee: WaveWrecker, LLC, El Cajon, CA (US)

( * ) Notice: Subject to any disclaimer, the term of this patent is extended or adjusted under 35 U.S.C. 154(b) by 0 days.

(21) Appl. No.: 14/956,101

(22) Filed: Dec. 1, 2015

(51) Int. Cl.

| | |
|---|---|
| ***B63B 35/00*** | (2006.01) |
| ***A41D 13/012*** | (2006.01) |
| ***A41D 7/00*** | (2006.01) |
| *B63B 35/79* | (2006.01) |

(52) U.S. Cl.
CPC ..... *A41D 13/012* (2013.01); *A41D 7/005* (2013.01); *B63B 2035/7903* (2013.01)

(58) Field of Classification Search
CPC ..... A41D 13/012; A63B 31/12
USPC ..... 441/64, 60
See application file for complete search history.

(56) References Cited

U.S. PATENT DOCUMENTS

| | | | | |
|---|---|---|---|---|
| 1,369,669 A | | 2/1921 | Kamenos | |
| 1,675,372 A | * | 7/1928 | Mohr | A63B 31/00 2/400 |
| 2,851,707 A | * | 9/1958 | Samuels | A63B 31/00 128/201.27 |
| 3,286,287 A | | 11/1966 | Martin | |
| 3,398,406 A | | 8/1968 | Waterbury | |
| 3,803,652 A | | 4/1974 | Uyehara | |
| D245,532 S | | 8/1977 | Taylor | |
| 4,397,636 A | | 8/1983 | Ganshaw et al. | |
| 4,602,384 A | | 7/1986 | Schneider | |
| 4,710,978 A | | 12/1987 | Pankopf et al. | |
| 5,013,271 A | | 5/1991 | Bartlett et al. | |
| 5,015,208 A | | 5/1991 | Fox et al. | |
| 5,033,116 A | | 7/1991 | Itagaki et al. | |
| 5,052,053 A | | 10/1991 | Peart et al. | |

(Continued)

FOREIGN PATENT DOCUMENTS

| | | |
|---|---|---|
| WO | 9200123 A1 | 1/1992 |
| WO | 9607455 A1 | 3/1996 |

(Continued)

OTHER PUBLICATIONS

Patent Examination Report No. 1 for related Australia Patent Application No. 2010340109 dated Apr. 7, 2014, in 4 pages.

(Continued)

*Primary Examiner* — Stephen Avila
(74) *Attorney, Agent, or Firm* — Procopio, Cory, Hargreaves & Savitch LLP; Lisa Maria Ferguson

(57) ABSTRACT

A lower body garment for wear while surfing, swimming or body surfing has a lower torso portion for enclosing the lower torso of a wearer and right and left legs depending downward for enclosing at least the thigh portion of a wearer's right and left legs, respectively, each leg having a lower end opening, the lower torso portion having an upper band portion for securing the garment around a wearer's torso, and one or more right and left thigh fins secured to the outer right and left side portions of the garment, respectively, and projecting laterally outward from the garment. The legs may be shorts length and end above the knee or extend below the knee to the lower calf or ankles.

14 Claims, 5 Drawing Sheets

(56) References Cited

U.S. PATENT DOCUMENTS

| | | | | |
|---|---|---|---|---|
| 5,106,331 | A | 4/1992 | Lizarazu et al. | |
| 5,173,068 | A | 12/1992 | Dunn et al. | |
| 5,183,424 | A | 2/1993 | Field | |
| 6,213,831 | B1 | 4/2001 | Smith | |
| RE37,533 | E | 1/2002 | Beige et al. | |
| 6,446,264 | B2 | 9/2002 | Fairhurst et al. | |
| 8,069,494 | B2 | 12/2011 | Sundnes | |
| 8,662,946 | B2 | 3/2014 | Gadler | |
| 8,851,006 | B2 | 10/2014 | Burga | |
| 9,493,218 | B2 | 11/2016 | Gadler | |
| 2006/0073943 | A1 | 4/2006 | Perka | |
| 2006/0089066 | A1* | 4/2006 | Wilson | A63B 31/11 441/64 |
| 2008/0020660 | A1 | 1/2008 | Barney | |
| 2011/0151733 | A1* | 6/2011 | Gadler | B63C 9/093 441/64 |
| 2013/0031691 | A1 | 2/2013 | Burga | |
| 2013/0217281 | A1 | 8/2013 | Gadler | |

FOREIGN PATENT DOCUMENTS

| | | | |
|---|---|---|---|
| WO | 2011084424 | A2 | 7/2011 |
| WO | 2015108632 | A1 | 7/2015 |

OTHER PUBLICATIONS

First Office Action for related Chinese Patent Application No. 201080016205.9 dated Aug. 15, 2012 and corresponding English translation, in 9 pages.

First Office Action for related Mexican Patent Application No. MX/a/2012/007165 dated Oct. 1, 2014 (English translation not available) in 2 pages.

First Examination Report for related New Zealand Patent Application No. 600463 dated Feb. 20, 2013, in 3 pages.

International Search Report and Written Opinion for related PCT/US2010/060310 dated Aug. 31, 2011, in 10 pages.

International Search Report and Written Opinion for related PCT/US2014/069139 dated Apr. 13, 2015, in 22 pages.

Office Action for related Korean Patent Application No. 10-2011-7023271 dated Oct. 26, 2016 and corresponding English translation, in 10 pages.

International Search Report and Written Opinion for related PCT/US2016/062310 dated Dec. 28, 2016, in 7 pages.

* cited by examiner

BODY SURFING GARMENT

BACKGROUND

1. Field of the Invention

This invention relates generally to body surfing, and more particularly to a lower body garment for wearing during body surfing or other water activities and which assists with buoyancy and also improves velocity and directional control while body surfing.

2. Related Art

Body surfing is a way to enjoy the thrill of riding a wave. Body surfers, generally, simply extend their bodies horizontally, projecting their arms forward and in line with their body while allowing a breaking wave to drive them shoreward with the surf. To the body surfer, it is important to be able to ride waves of varied sizes, to enjoy a stable ride and to be able to control direction and position on a wave face. Since a body surfer rarely uses any equipment other than swim fins, it is quite difficult for a body surfer to adequately control the stability of his ride and control his direction and position on a wave face.

U.S. Pat. No. 8,662,946 of Gadler describes a body surfing suit with fins located at various locations on the torso, arms and legs of the suit.

SUMMARY

According to one aspect, a lower body garment for wear while surfing, swimming or body surfing is provided which comprises a lower torso portion for enclosing the lower torso of a wearer and right and left legs depending downward from the lower torso portion for enclosing at least an upper portion of a wearer's right and left legs, respectively, each leg having a lower end opening, the lower torso portion having an upper waist or band portion for securing the garment around a wearer's torso at or close to the waist, the garment having outer right and left side portions extending from the waist portion to the lower ends of the respective right and left legs, and right and left fins secured to the outer right and left side portions of the garment, respectively, and projecting laterally outward from the garment. In one embodiment, a single fin is provided on each side of the garment and each fin extends from an upper end spaced below the waist portion and above the respective leg to a lower end spaced above the respective leg opening. In another embodiment, each fin is segmented vertically or horizontally by sliced, parallel cuts extending to a predetermined depth in the fin. In an alternative embodiment, multiple smaller, separate laterally extending fins may be arranged side-by-side on each side portion of the garment.

According to another aspect, the garment is fabricated from a suitable lightweight, stretchable, water and UV resistant material suitable for wear while swimming or surfing, such as a synthetic rubber or plastic material such as neoprene in various thicknesses. This material assists with buoyancy in the water when a wearer is swimming or surfing.

In one aspect, the fins may be fabricated of a rigid or semi-rigid material such as flotation foam. In one aspect, the fins may be uncovered. In another aspect, the fins may be covered with a flexible material which may be similar to or the same material as the remainder of the garment. Each fin is located in the lateral thigh region of the leg and in one aspect each fin extends along part of the height, most of the height or the entire height of the wearer's thigh. In one embodiment, the garment comprises shorts with legs terminating just above a wearer's knees. In other embodiments, the legs may extend below the knees and terminate anywhere between the knees and ankles. In one embodiment of pants with below knee or full length legs, lower, laterally extending fins may also be provided on lateral portions of the garment below the knees. In some aspects, fins are provided only on the thigh portions of the garment, only on the lower leg portions of the garment, or on both the thigh and lower leg portions of the garment.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
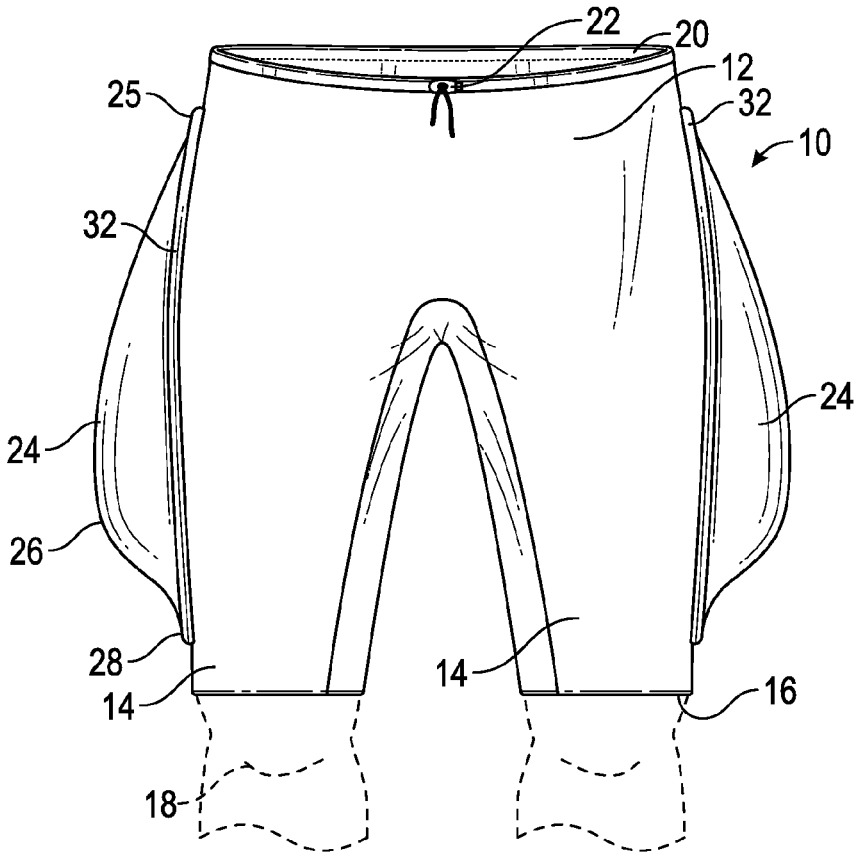
FIG. 1 is a front elevation view a first embodiment of a lower body surfing garment comprising shorts with fins, illustrating a wearer's knees in dotted outline.

Certain embodiments as disclosed herein provide for a body surfing garment for the lower torso having laterally extending thigh fins for stabilization of the surfer and for providing better direction and position control while swimming or surfing.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 5 illustrate one embodiment of a lower body garment 10 for wearing while swimming, surfing, body surfing or the like. In the illustrated embodiment, the garment 10 comprises body surfing shorts, but may have longer legs in alternative embodiments, such as legs which extend below the knee, or full length legs extending to the ankle, as illustrated in the alternative embodiment of the lower body garment 50 of FIG. 6.

In one embodiment, body surfing shorts 10 comprise lower torso portion 12 for enclosing the lower torso 11 of a wearer and right and left legs 14 depending downward from the lower torso portion for enclosing at least the wearer's thighs. Each leg has a lower end opening 16 located at or just a above a wearer's knee 18 (see FIGS. 1 and 5). The lower torso portion 12 has an upper waist portion or waistband 20 for securing the garment around a wearer's waist. The waistband may be designed to be higher or lower on the wearer's torso than the position shown in FIG. 5 in alternative embodiments. Any suitable fastening means may be provided for securing the waistband 20 about the waist, such as a barrel lock 22 as illustrated, or a cam buckle, pinch buckle, twist lock, ratchet buckle, button, hook and loop fastener material such as VELCRO®, or the like, and these devices may be used alone or together with a zipper fastener. Alternatively, the waistband may be elasticated so that the shorts are pull-on and require no fastener.

Figure 2:
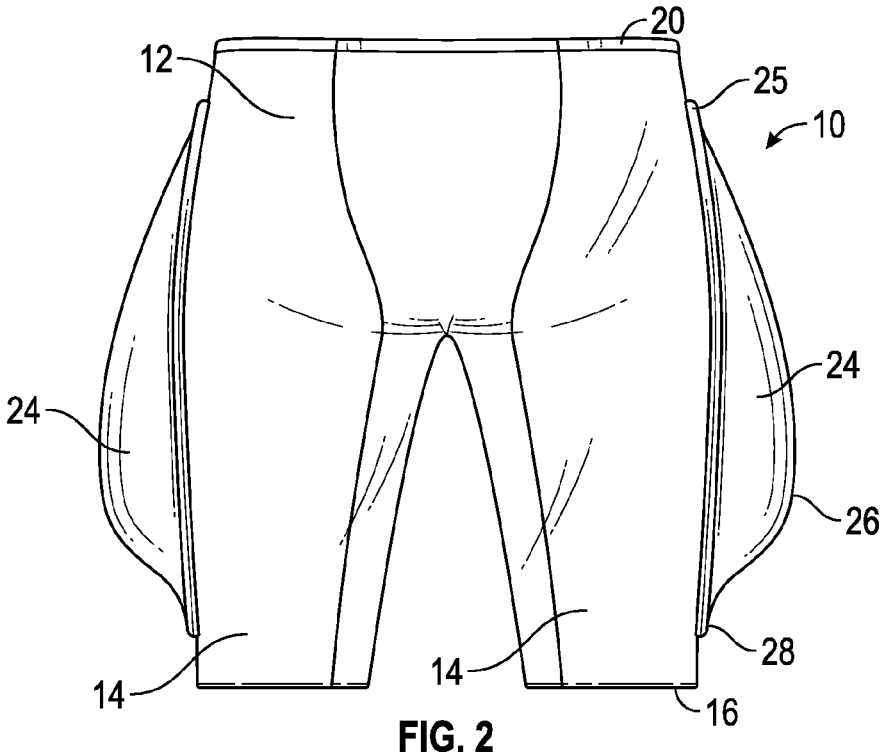
FIG. 2 is a rear elevation view of the body surfing shorts of FIG. 1.
Figure 3:
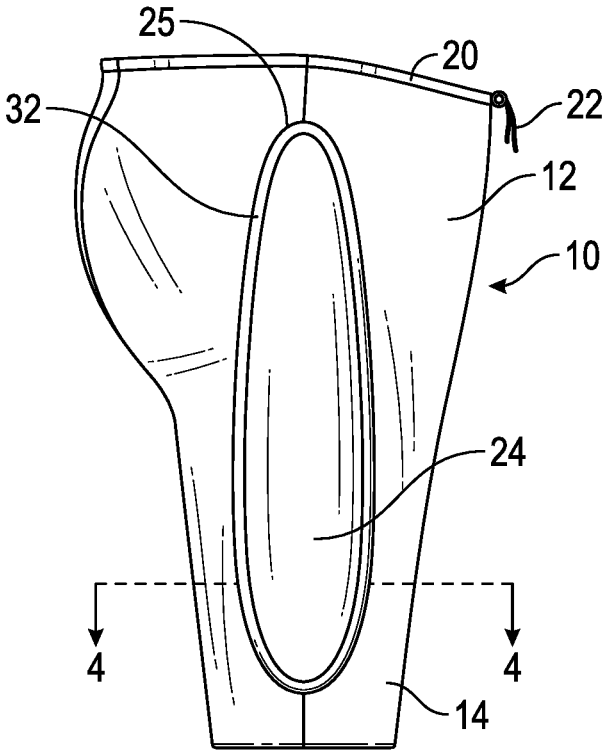
FIG. 3 is right side elevation view of the body surfing shorts of FIGS. 1 and 2, the left side elevation view being a mirror image thereof.

In one embodiment, a single lateral leg or thigh fin 24 is located on each side of the shorts 10 and extends laterally outward from the shorts, as seen in FIGS. 1 to 5. Each fin extends along most of the height of the respective outer side of the shorts, from a location 25 just below waistband 20 to a location 28 just above the respective leg opening 16, over the entire thigh region of the wearer. The fins 24 allow the wearer to control direction more easily when riding a wave, and also add buoyancy. As best seen in FIGS. 1 and 2, each fin curves or bulges outwardly at its outer periphery from the upper end 25 to a maximum height portion 26, and then curves inward to the lower end 28 of the fin. As illustrated in FIG. 3, each fin is of generally tear drop shape in side elevation with a narrower upper end 25 extending downward to a wider, curved lower end.

The shorts 10 are fabricated from a suitable lightweight, stretchable, water and UV resistant material suitable for wear while swimming or surfing, for example, a synthetic rubber or plastic material, such as neoprene in various thicknesses. This material assists with buoyancy in the water when a wearer is swimming or surfing.

Figure 4:
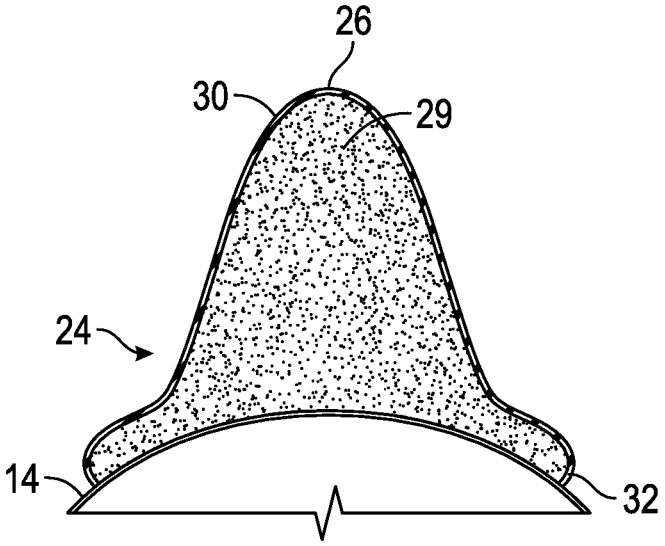
FIG. 4 is a cross-sectional view of the right hand side fin of FIGS. 1 to 3 taken on the lines 4-4 of FIG. 3 on a larger scale.
Figure 5:
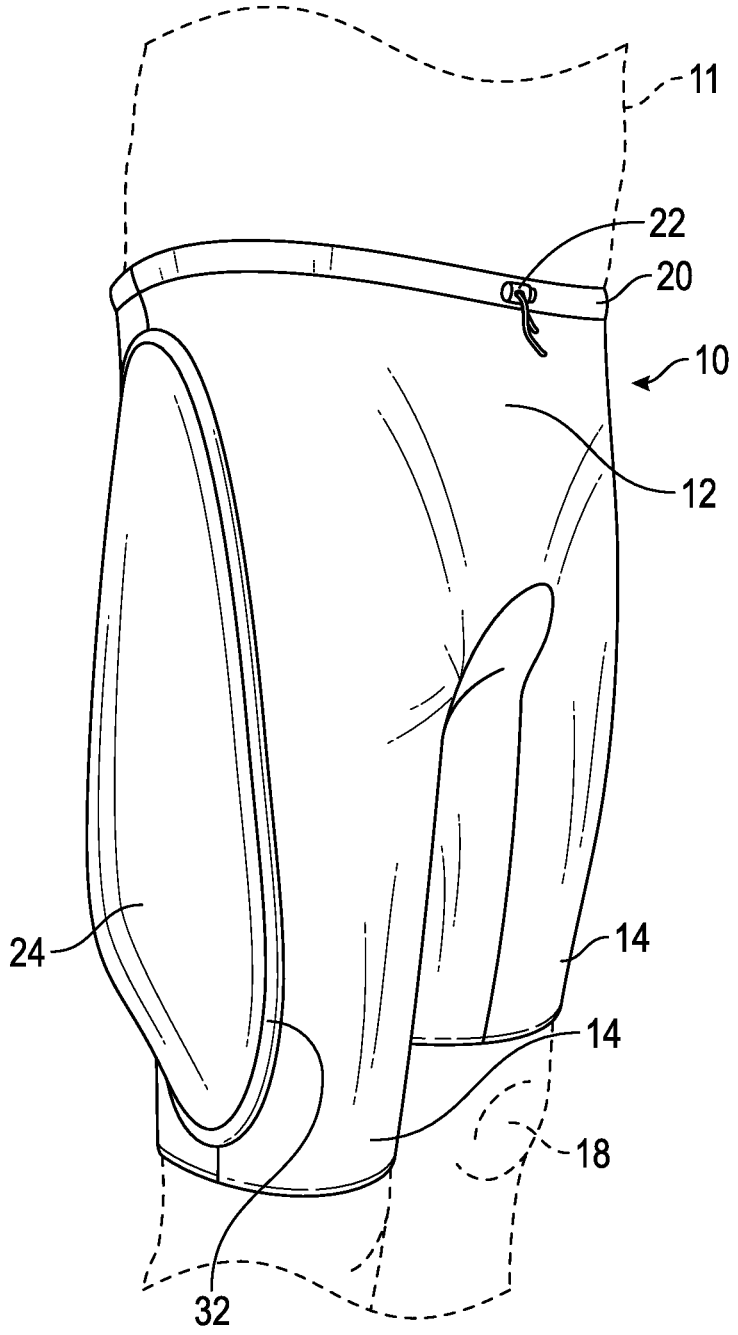
FIG. 5 is a side perspective view of the body surfing shorts of FIGS. 1 to 4 illustrating the torso and knees of a wearer in dotted outline.

In one aspect, the fins may be fabricated of a rigid or semi-rigid material or flotation foam 29, as illustrated in FIG. 4 and may be covered with a thin layer 30 of flexible material or fabric as illustrated, or may have no fabric cover in other embodiments. If present, layer 30 may be of similar material or the same material as the remainder of the garment, or may be a nylon fabric co-molded onto the foam material of the fin in one embodiment. Any suitable material may be used for manufacturing fins 24, such as ethylene vinyl acetate (EVA) foam, polyurethane foam, or foams of polyolefin, polyethylene, or the like. In some embodiments, the fins may have regions of different density or hardness, such as a harder or denser core or blade sandwiched between soft flexible foam outer layers, with the layers secured together by adhesive, heat sealing, bonding, or the like. The denser core or blade may be of fiberglass, carbon fiber, dense plastic, denser foam material, or the like.

Each fin is located in the lateral thigh region of the leg and extends along most of the height or the entire height of the thigh. In one embodiment, each fin 24 extends from the top of the iliac crest laterally downward to just above the knee. In some embodiments, lateral leg or thigh fins 24 may range from about 10 mm to 500 millimeters tall at their highest point. In one embodiment, fins 24 may be about 70 to 85 millimeters tall at their highest point 26. In some embodiments, the width of the fin ranges from around 2 mm to around 300 mm. In some embodiments, the width of the fin at its widest point in FIG. 4 is 40 mm to 300 mm, and it tapers to a rounded point of around 15 mm width at its upper end. The maximum width may be around 80 to 250 mm. in some embodiments. The length of the fin from its upper end to its lower end may range from 5 mm to 800 mm. The fins are provided in a range of sizes, one for each size of shorts from children to adult sizes, with incremental increase in length, width and height from the smallest to the largest size.

The lateral leg fins 24 may be contoured precisely to the underlying anatomy of the upper leg and may be secured to the underlying shorts leg via stitched seams 32 around the outer periphery of the fabric layer covering the fin, or in any other suitable manner such as heat sealing, adhesive, or the like. In an alternative embodiment, the shorts may be manufactured with pockets into which the respective fins may be inserted, for example in a similar manner to the removable fins described in my co-pending application Ser. No. 14/148,465 filed on Jan. 17, 2014 and published as US Pat. App. Pub. No. 20140134902, the contents of which are incorporated herein by reference. The upper end portion of each lateral leg fin is contoured at a relatively low height so as not to interfere with the hand during a swimming stroke. In some embodiments, the upper lateral leg fins may be shaped like a dolphin fin. The lateral leg fins may create a more streamlined effect which may increase water displacement during a kicking stroke which results in greater propulsion through the water. The lateral leg or thigh fins may also provide greater stability. In some embodiments, the upper lateral leg fins provide buoyancy to the upper leg but still maintain anterior-posterior neutral buoyancy.

Fins 24 may be of different shapes, dimensions and materials in alternative embodiments. In some embodiments, the single fins may be replaced with multiple smaller fins or segmented fins over substantially the same lateral thigh region of the shorts, and some embodiments with alternative fins are described in more detail below in connection with FIGS. 7 and 8.

Figure 6:
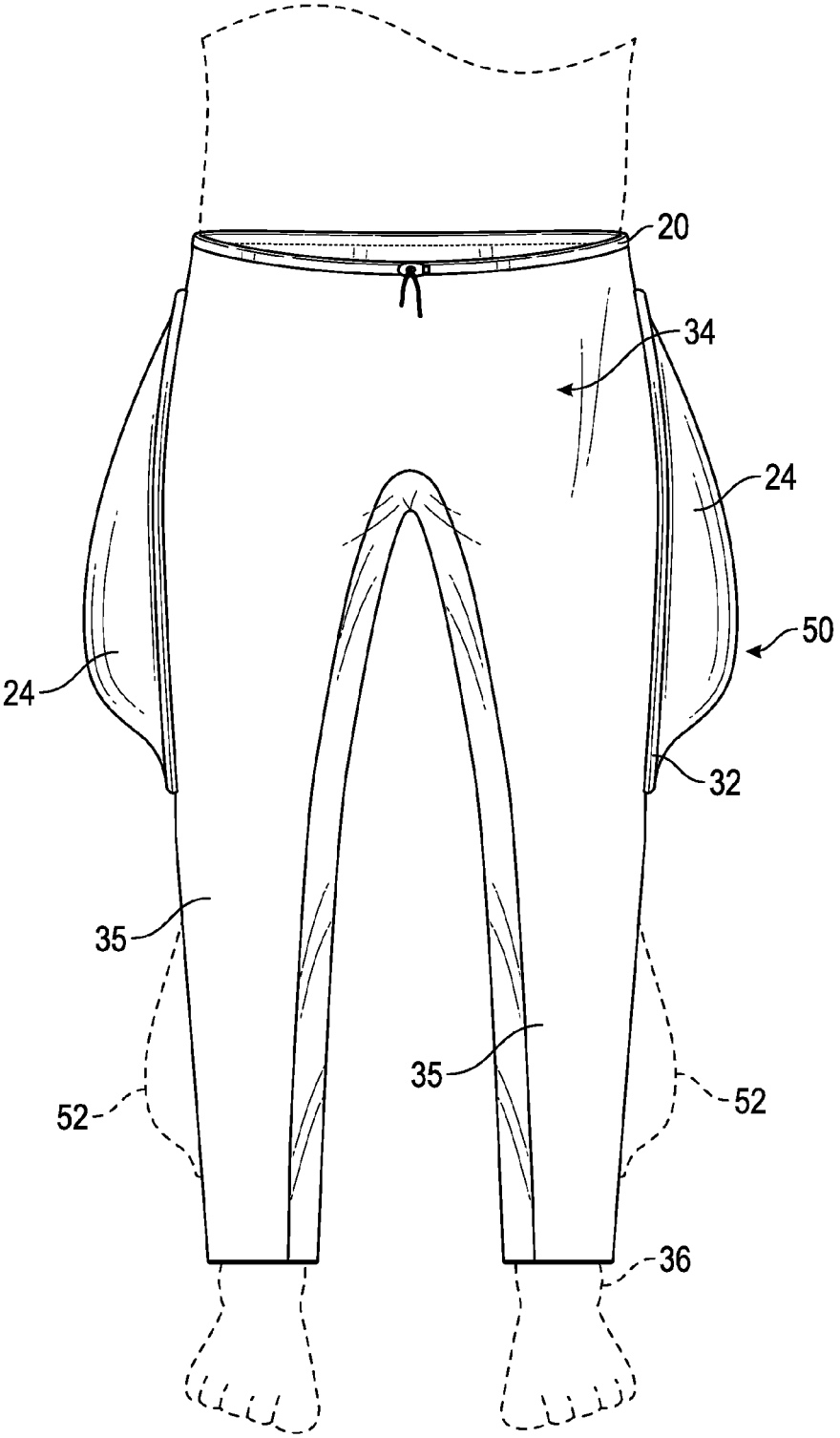
FIG. 6 is a front elevation view of a second embodiment of a lower body surfing garment similar to that of FIGS. 1 to 5 but with full length legs, illustrating the wearer's torso and feet in dotted outline, and also illustrating optional lower leg fins in dotted outline.

In some embodiments, the legs of the garment may be extended to locations below the knee. FIG. 6 illustrates an alternative embodiment in which the garment 50 has full length legs 35 extending to a wearer's ankles 36. In alternative embodiments, the garment may have legs which extend below the knee but terminate above the wearer's ankles. The garment 50 includes thigh or lateral leg fins 24 which may be similar or identical to those of FIGS. 1 to 5, or those of FIGS. 7 and 8 described below. Other elements of garment 50 are identical to elements of shorts 10 of FIGS. 1 to 5, and like reference numbers are used for like parts as appropriate. In some embodiments, additional left and right fins 52 may be provided in the lower leg regions of pants legs 35, as illustrated in dotted outline in FIG. 6. Each fin 52 is located in the lateral calf region of the leg aligned with the corresponding lateral thigh fin 24 and projects laterally outwards. Fins 52 may be of similar shape or contour to fins 24 but of slightly smaller dimensions, extending from a location just below the knee to a location spaced above the lower ends of the pant legs. In one embodiment, only upper fins 35 may be provided, while in other embodiments both upper fins 35 and lower fins 52 may be provided, or lower fins only may be provided. Lower leg fins of appropriate size may also be provided in garments with legs extending below the knee but with lower ends spaced above the ankles, for example to mid-calf length.

Figure 7:
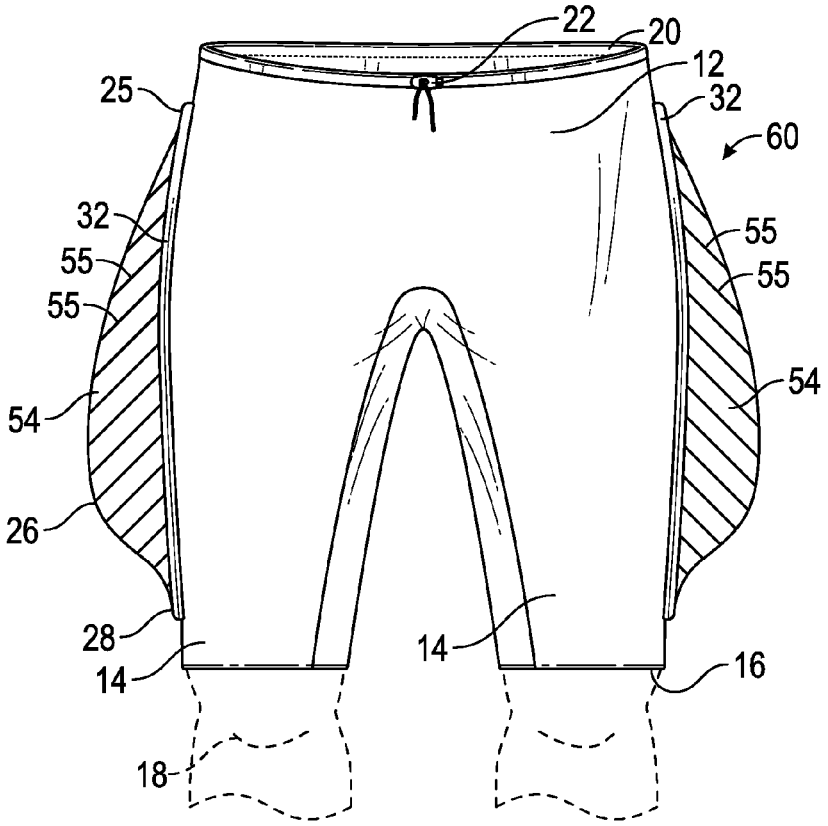
FIG. 7 is a front elevation view similar to FIG. 1 illustrating a third embodiment of body surfing shorts with segmented fins.

FIG. 7 illustrates an alternative embodiment of shorts 60 in which the one piece, lateral thigh fins 24 of the shorts of FIGS. 1 to 5 are replaced with segmented or sliced fins 54 similar to the segmented or sliced fins described in co-pending application Ser. No. 14/148,465 cited above. Each fin 54 is of similar or identical shape and dimensions to corresponding fin 24, but has a plurality of angled, sliced cuts 55 extending to a certain depth in the fin. The cuts 55 may be equally spaced as illustrated or the spacing between cuts may be varied in other embodiments. The depth of the sliced cuts may range from around 2 mm to around 300 mm. In some embodiments, the sliced cuts divide the fin into layers or segments which may be individually attached to an underlying layer or to the shorts leg itself. The segmented or sliced fins provide additional flexibility. The cuts may be angled downward as illustrated in FIG. 7, i.e. in the direction of water flow around the fins when the wearer is swimming or surfing. In alternative embodiments, the fins may have generally vertically extending cuts or slices extending upwards in the fin, rather than inwardly directed angled cuts. Apart from segmented or sliced fins 54, the shorts 60 are otherwise identical to the shorts 10 of FIG. 1, and like reference numbers are used for like parts. In the pants version of FIG. 6, lower leg fins 52, if present, may also be either solid or one piece fins, or sliced or segmented as illustrated in FIG. 7.

Figure 8:
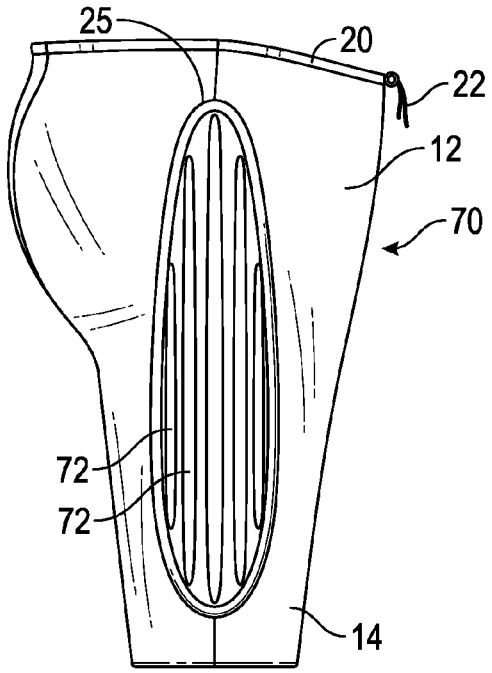
FIG. 8 is a side elevation view similar to FIG. 3 but illustrating an alternative embodiment where each side portion of the shorts has a plurality of separate, side-by-side fins.

In some embodiments, the fins 24 and 52 of FIGS. 1 to 6 may be formed in multiple parts or may be replaced by multiple smaller fins extending over approximately the same lateral thigh or calf region covered by fin 24 or 52. FIG. 8 illustrates one embodiment of shorts 70 in which the single fins 24 of FIGS. 1 to 5 are replaced by multiple narrow, laterally extending fins 72 arranged side by side on the lateral thigh region of each shorts leg 14. The side fins 72 may be of different sizes or lengths to cover the desired region of the thigh. In this case, each fin 72 may be individually secured to the respective pants leg 14, or the fins may be mounted on a base which is suitably attached to the pants leg. Fins 72 may together form substantially the same overall profile as the single fins of FIGS. 1 to 6, or may form a different streamline profile in other embodiments.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

I claim:

1. A lower body garment for wear while surfing, swimming or body surfing, comprising:

a lower torso portion for enclosing the lower torso of a wearer and right and left legs depending downward from the lower torso portion for enclosing at least an upper portion of a wearer's right and left legs, respectively, each leg having a lower end opening;

the lower torso portion having an upper band portion configured for securing the garment around a wearer's torso;

outer right and left side portions extending from the upper band portion to the lower end openings of the respective right and left legs; and at least one right lateral fin and at least one left lateral fin secured to the outer right and left side portions of the garment, respectively, and projecting laterally outward from the garment, each lateral fin having an upper end and a lower end;

wherein each fin has a streamlined profile and curves laterally outward from the upper end towards the lower end to a maximum height portion and then curves inward to the lower end, the maximum height portion being closer to the lower end than the upper end.

2. The garment of claim 1, comprising a single right lateral fin and a single left lateral fin, wherein the upper end of each fin is spaced below the band portion.

3. The garment of claim 1, wherein the garment comprises a pair of swim shorts and the lower end openings of the legs are configured to be located above the knee when the swim shorts are worn.

4. The garment of claim 1, wherein the garment comprises a pair of swim pants and the lower end openings of the legs are configured to be located below the knee when the swim pants are worn.

5. The garment of claim 4, wherein at least one right lateral fin and at least one left lateral fin are secured to the respective outer right and left thigh portions of the pants legs.

6. The garment of claim 4, wherein at least one right lateral fin and at least one left lateral fin are secured to the respective outer portions of the pants legs below a knee portion of the respective pants leg.

7. The garment of claim 4, wherein first and second right lateral fins and first and second left lateral fins are secured to the outer right and left portions of the pants legs, the first right and left lateral fins being located above a knee portion of the respective pants leg and the second right and left lateral fins being located below a knee portion of the respective pants leg.

8. The garment of claim 1, wherein the left and right lateral fins are each shaped like a dolphin fin.

9. The garment of claim 1, wherein each fin has a transverse width which increases from the upper end towards the lower end to a maximum width corresponding to the maximum height portion, and curves inward from the maximum width to the lower end.

10. The garment of claim 1, wherein each fin has one or more sliced cuts extending inward from an outer surface to a predetermined depth in the fin.

11. The garment of claim 10, wherein each fin has a plurality of spaced, parallel sliced cuts.

12. The garment of claim 11, wherein the sliced cuts extend through the fin to form separate layers, and the separate layers have inner ends secured to the respective leg of the garment.

13. The garment of claim 1, wherein a plurality of separate right lateral fins and separate left lateral fins are secured side-by-side to predetermined regions of the outer right and left side portions of the garment, respectively.

14. The garment of claim 13, wherein at least some of the lateral fins are of different sizes.

* * * * *